US008419411B2

(12) United States Patent
Clauwaert et al.

(10) Patent No.: US 8,419,411 B2
(45) Date of Patent: Apr. 16, 2013

(54) AEROSOL CONTAINER

(75) Inventors: Werner Marie Camiel Clauwaert, Groot Bijgaarden (BE); Annick Albertine Alfons Dumon, Zoutleeuw (BE); Luc Bart Spelmans, Sint-Truiden (BE); Marcel Braakhekke, Eindhoven (NL)

(73) Assignee: Friesland Brands B.V. (NL)

( * ) Notice: Subject to any disclaimer, the term of this patent is extended or adjusted under 35 U.S.C. 154(b) by 819 days.

(21) Appl. No.: 12/440,674

(22) PCT Filed: Sep. 11, 2006

(86) PCT No.: PCT/NL2006/000448

§ 371 (c)(1),
(2), (4) Date: Jul. 27, 2009

(87) PCT Pub. No.: WO2008/033005

PCT Pub. Date: Mar. 20, 2008

(65) Prior Publication Data

US 2010/0062096 A1 Mar. 11, 2010

(51) Int. Cl.
*A23P 1/12* (2006.01)

(52) U.S. Cl.
USPC ..... 425/376.1; 222/389; 222/402.13; 222/402.21; 425/461

(58) Field of Classification Search ..... 425/376.1, 425/461; 222/386, 389, 394, 402.13, 402.21, 222/402.22, 402.23
See application file for complete search history.

(56) References Cited

U.S. PATENT DOCUMENTS

| | | | | |
|---|---|---|---|---|
| 2,892,575 | A * | 6/1959 | Turk | 222/394 |
| 3,263,744 | A | 8/1966 | MacKeown | |
| 3,350,159 | A | 10/1967 | Rice, Jr. | |
| 3,606,266 | A * | 9/1971 | MacManus | 425/200 |
| 3,722,760 | A * | 3/1973 | Hug | 222/402.22 |
| 2005/0193744 | A1 | 9/2005 | Cockings et al. | |

FOREIGN PATENT DOCUMENTS

| | | |
|---|---|---|
| DE | 75 27 199 | 4/1976 |
| FR | 2 281 287 | 3/1976 |
| FR | 2 570 000 | 3/1986 |
| GB | 1 500 028 | 2/1978 |
| GB | 2 049 826 A | 12/1980 |

OTHER PUBLICATIONS

Annexe 4 : D4 : impressions Web Back Machine du site http://www.espressosupply.com datant du 31 mars 2004 (récipient + buse) et du 7 juillet 2004 (buse) pp. 75 to 78, Jul. 7, 2004.

* cited by examiner

*Primary Examiner* — Yogendra Gupta
*Assistant Examiner* — Joseph Leyson
(74) *Attorney, Agent, or Firm* — Jennifer E. Lacroix, Esq.; DLA Piper US LLP

(57) ABSTRACT

An aerosol container (1), comprising:—a reservoir (2) containing a propellant and a foodproduct;—operable discharge means (3) to discharge the foodproduct;—a dispensing head (10) defining a foodproduct receiving space (11) to receive the foodproduct from the discharge means (3), a distal part (15) of the head (10) having foodproduct shaping projections (12), wherein the foodproduct receiving space comprises an upstream foodproduct receiving space (11A, 11B) that widens, viewed in a foodproduct discharge direction, wherein a maximum diameter (D1) of the foodproduct receiving space of the dispensing head is larger than about 2 cm.

11 Claims, 4 Drawing Sheets

AEROSOL CONTAINER

Figure 1:
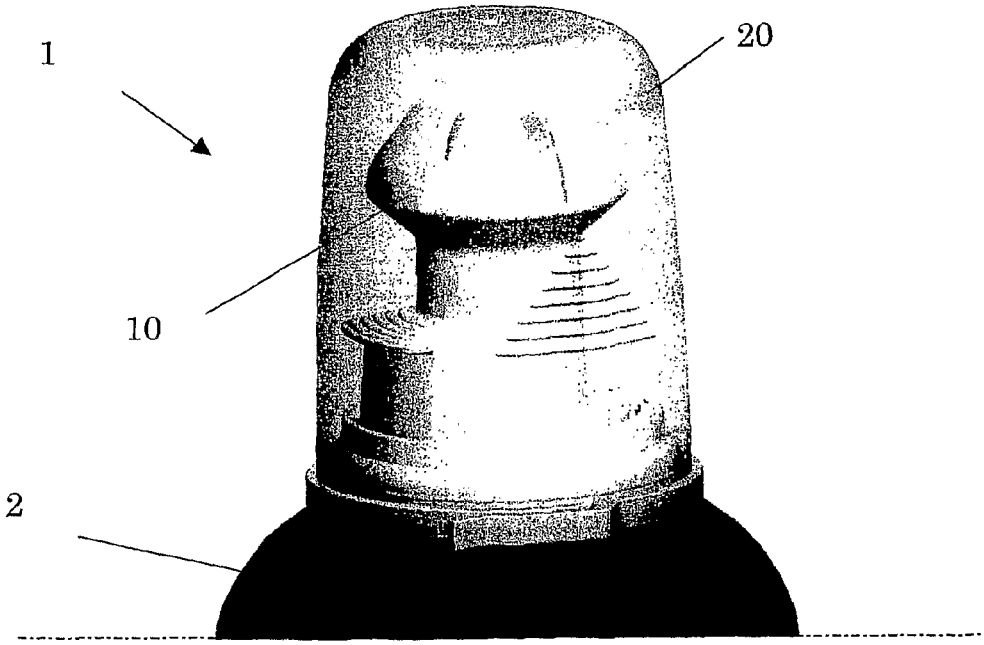

The invention relates to an aerosol container, comprising:

a reservoir containing a propellant and a foodproduct;

operable discharge means to discharge the foodproduct; and a dispensing head defining a foodproduct receiving space to receive the foodproduct from the discharge means, a distal part of the head having foodproduct shaping projections.

A container, in which the foodproduct comprises cream, is currently marketed and sold by the applicant. The known container is lightweight, compact and designed to be disposed after being used-up.

Particularly, during operation of the aerosol container, in case of operating the discharge means, cream is ejected via the dispensing head and undergoes a so called 'overrun', such that a 'spray cream' which resembles common whipped cream, is obtained.

In the known device, the foodproduct receiving space is a substantially cylindrical space. The container comprises valve means and a small discharge nozzle. During activation, the nozzle sprays the cream into the cylindrical space, upon which the cream preferably expands to a desired degree and is agitated vigorously due to expanding propellant.

A downstream discharge opening of the foodproduct receiving space is partly blocked by said cream shaping projections. The known foodproduct shaping projections are curved towards each other to press outflowing cream locally inwardly, to profile the cream. The contour of resulting cream, discharged from the container, is provided with a desired relief, particularly indents which have been pressed or cut into the cream by the mentioned projections of the dispensing head. A thus shaped cream is desired in applications where a small amount of cream (i.e. a dot or rosette of cream) is to decorate a food product, such as pie, or a beverage such as chocolate milk or coffee.

An object of the present invention is to provide an aerosol container which can achieve an improved shaping of the foodproduct, such that a dispensed spray foodproduct having an improved sharp relief can be obtained there-from.

To this aim, according to an embodiment of the invention, the aerosol container is characterised in that the foodproduct receiving space comprises an upstream foodproduct receiving space that widens, viewed in a foodproduct discharge direction, wherein a maximum diameter of the foodproduct receiving space of the dispensing head is preferably larger than about 2 cm.

It has been found that in case an upstream widening foodproduct receiving space is provided, wherein a maximum diameter of that space is relatively broad, the aerosol container can generate spray foodproduct having a relatively sharp relief. Particularly, the present container can deliver a small amount of foodproduct having a rosette-shape with a sharp relief, the relief comprising sharp outer edges and intermediate 'valleys' that have been pressed into the foodproduct by respective foodproduct shaping projections of the discharge head.

In a further embodiment, the foodproduct comprises cream. For example, cream can be a main ingredient of the foodproduct. Other foodproducts, to be applied in the present invention, can be, for example: deserts, mousses, food garnishing products or different foodproducts.

Empirically, it has been found that the aerosol container according to the present invention provides significantly improved shaping of dispensed foodproduct, during the spraying of the foodproduct. Without wishing to be bound to theory, an explanation might be that the widening foodproduct receiving space can provide a better controlled outflow of the foodproduct, which can still be expanding in the foodproduct receiving area, which might benefit the desired operation of the downstream foodproduct shaping projections.

Besides, the present foodproduct dispensing and shaping head can be made relatively compact and short, compared to conventional aerosol foodproduct dispensing heads, and can be cleansed thoroughly with relative ease.

Note, that automatic whipping cream dispensing machines, having discharge heads with projections to shape the cream, are known from the prior art. These machines can provide a dot of whipped cream having a well defined, sharp rosette relief as well. However, the known automatic whipping cream dispensers operate in an entirely different manner than the above-described aerosol container, as will be appreciated by the skilled person.

In a further embodiment, good results can be obtained in case at least a first part of an inner surface of the upstream dispensing head part, which defines at least a first part of the upstream foodproduct receiving space, extends along a virtual first conical plane. For example, the apex angle of the first conical virtual plane is in the range of 45-180 degrees, particularly in the range of 80-120 degrees. Besides, according to an embodiment, a second part of the inner surface of the upstream dispensing head part, defining at least a second part of the upstream foodproduct receiving space, extends upstream with respect to the first part of that surface, and extends along a virtual second conical plane. In that case, it has been found that preferably, the apex angle of the second conical virtual plane can be smaller than the apex angle of the first conical plane, and is for example in the range of about 5-45 degrees, and particularly in the range of 10-30 degrees. However, an optional second part of the inner surface of the upstream dispensing head part can also be shaped differently, for example cylindrically.

Also, according to a further embodiment, the inner surface of the distal part of the dispensing head can substantially extend along a virtual third conical surface, an apex angle of the third conical surface preferably being in the range of about 45-135 degrees and more preferably in the range of about 60-100 degrees, for example about 70 degrees.

The dispensing head can be dimensioned in various ways, however, it has been found that good foodproduct shaping results are provided when a length of the foodproduct receiving space, measured from a bottom of that space to a downstream lateral foodproduct discharge opening of the dispensing head, is relatively short, for example smaller than 3 cm, or in the range of about 2-3 cm. Thus, the foodproduct shaping projections can be located at a relatively short distance from the foodproduct discharge means of the container.

Also, advantageously, a maximum diameter of the foodproduct receiving space of the dispensing head can be relatively large, for example larger than 2 cm, or in the range of 2-3 cm. Without whishing to be bound to any theory, such broad foodproduct receiving space can lead to a relatively low foodproduct discharge speed (at least: lower than obtained with conventional aerosol foodproduct dispensing heads) at downstream foodproduct shaping projections, which might also lead to improved operation of the foodproduct shaping projections.

Preferably, the distal part of the dispensing head can be provided with foodproduct dispensing apertures or slits, such that opposite longitudinal sides of the foodproduct shaping projections abut these apertures. In a further preferred embodiment, these foodproduct dispensing apertures extend from an upstream end of an upstream contour of the widening foodproduct receiving space part.

Also, according to an embodiment, there is provided a method to manufacture an aerosol container, for example a container according to the invention, wherein the method comprises:

providing a cap comprising a dispensing head, the cap covering the head;

providing an aerosol container comprising operable discharge means, the container containing a propellant and a foodproduct; and joining the cap together with the head with the aerosol container, such that the head can cooperate with the discharge means of the container.

In this way, the assembly of the container can be simplified, so that throughput can be improved, for example compared to a manufacturing method wherein head and cap are being joined independently, in sequence, with the container. In the present method, preferably, the cap is a tamper evident cap, to indicate tampering. Alternatively, the head can comprise a tamper evident configuration.

Figure 2:
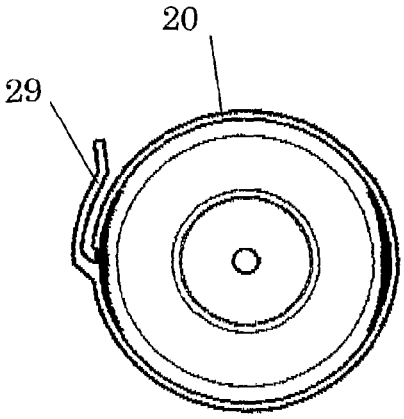
Figure 3:
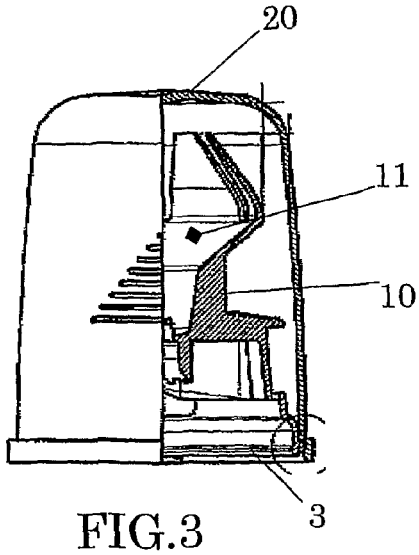
Figure 4:
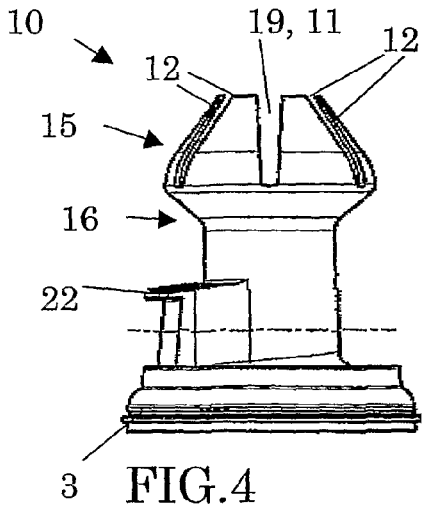
Figure 5:
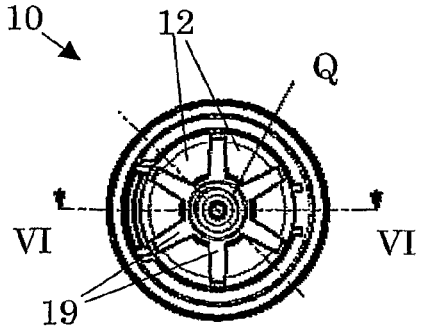
Figure 6A:
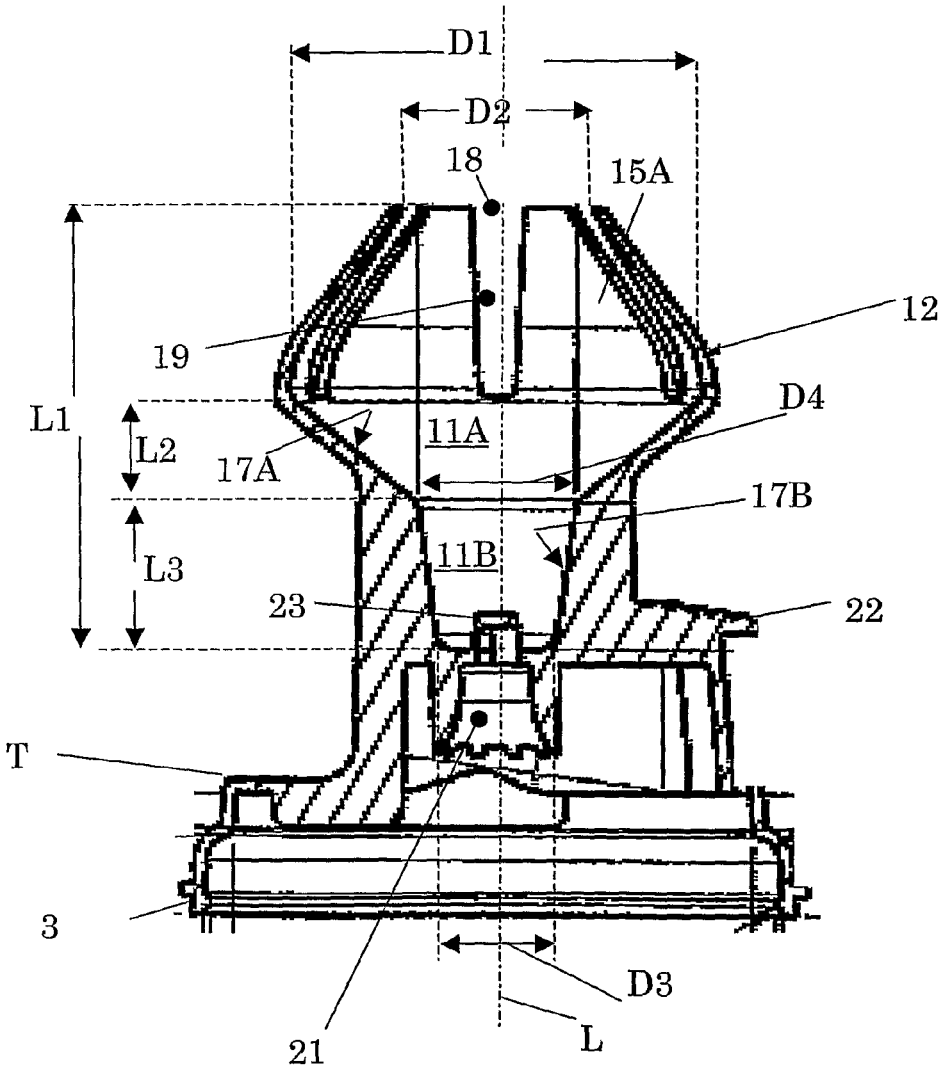
Figure 6B:
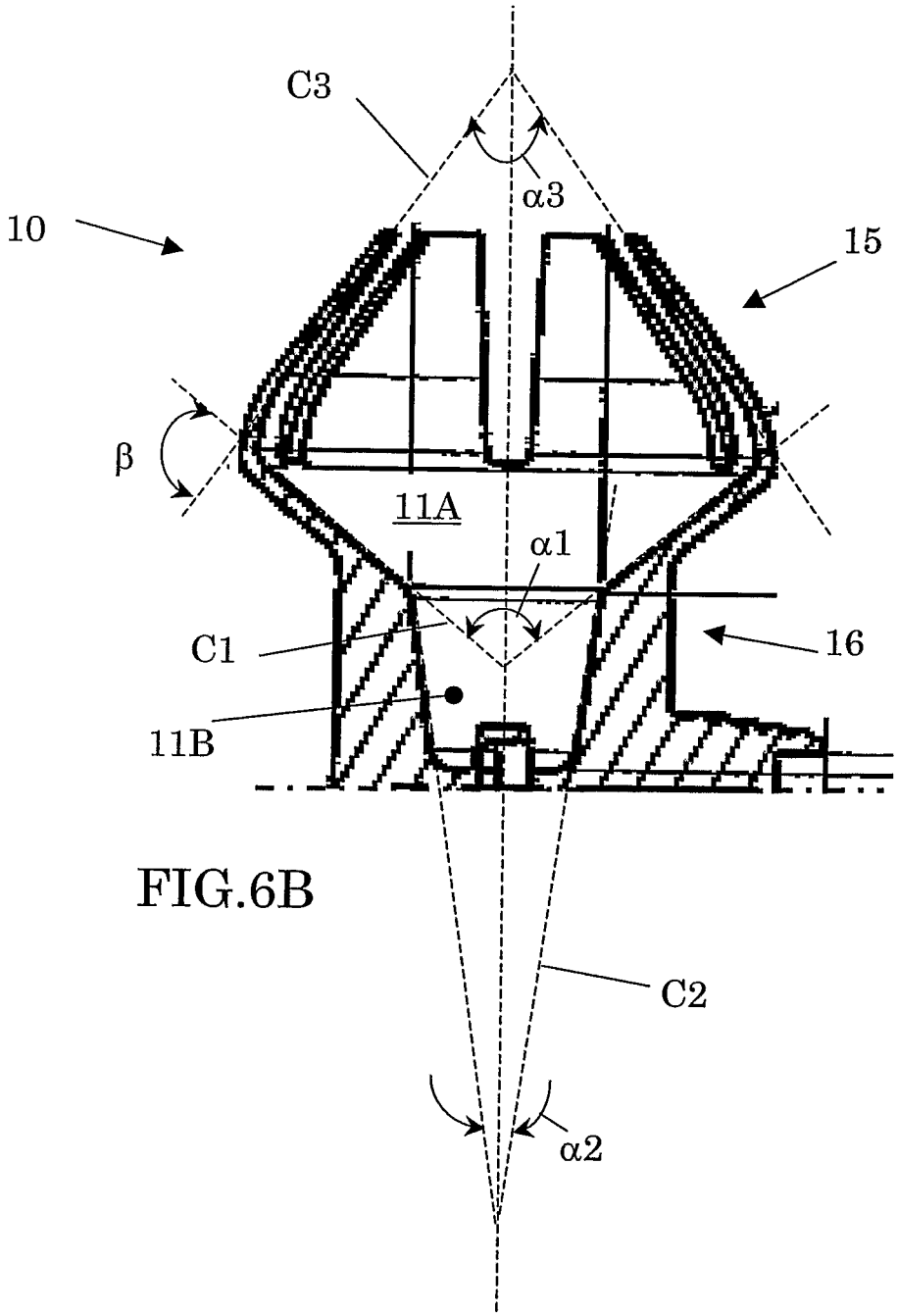
Figure 7:
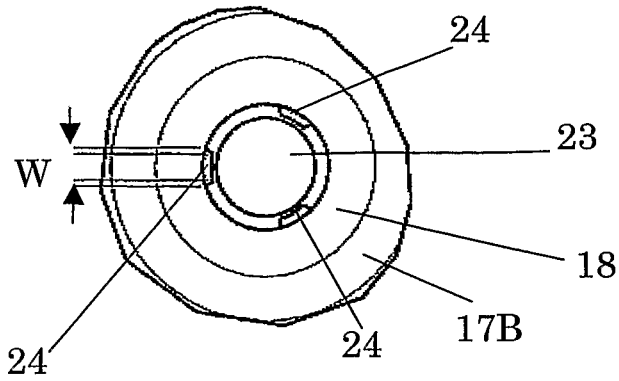
Figure 8:
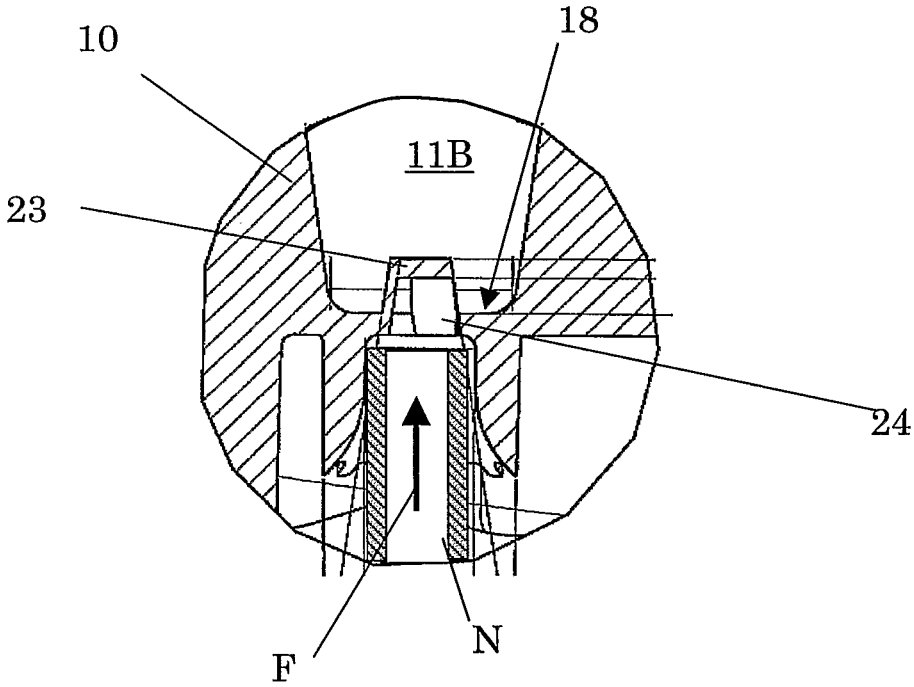

These and other aspects of the invention will be apparent from and elucidated with reference to the embodiments described hereafter. Therein shows:

FIG. 1 a perspective front view of an upper part of an embodiment of the invention FIG. 2 a top view of a cap of the embodiment of FIG. 1;

FIG. 3 a partially opened side view of the embodiment of FIG. 1, showing part of the dispensing head in cross-section;

FIG. 4 a side view of the dispensing head of the embodiment of FIG. 1;

FIG. 5 a top view of a central part of the head shown in FIG. 4;

FIG. 6A a longitudinal cross-section over line VI-VI of FIG. 5;

FIG. 6B a similar drawing as FIG. 6A, indicating various conical planes of inner surfaces of the dispensing head;

FIG. 7 a detail Q of FIG. 5, showing the bottom part of the foodproduct receiving space; and FIG. 8 a detail of FIG. 6A, depicting the aerosol dispensing nozzle and upstream bottom part of the foodproduct receiving space.

FIGS. 1-8 shown an embodiment of an aerosol container 1, to discharge and shape/model a foodproduct. The container is compact (for example with an overall volume less than 1 l), of a lightweight construction. Also for example, initially, a packed container, comprising the foodproduct, can weigh less than 1 kg, such as about 750 or 250 g. Preferably, the container as such is made of tinplate or aluminium, coated on the inside, and has a substantially cylindrical shape. Also, the present aerosol container 1 is of a non-refillable type, to be discarded after being used up. The present container 1 is of a relatively inexpensive, durable construction, having few components.

The container 1 comprises a reservoir 2 containing the foodproduct, the foodproduct being safe for consumption, and a suitable propellant. As a non limiting example, the aerosol container can be packed with foodproduct and propellant, the initial pressure in the container being for example in the range of 7-18 atmospheres, depending on the amount of packed foodproduct, as will be appreciated by the skilled person. The propellant can consist of one or more gasses acceptable from the viewpoint of food technology, for example a gas which substantially dissolves in the foodproduct, a gas which substantially does not dissolve in the foodproduct and a combination of these gasses. Particularly, the propellant can comprise CO2, nitrogen (N2), laughing gas (N2O) or a combination of these gasses (such as nitrogen and laughing gas). For example, 15-25 w % (weight %) of the propellant can be N2 and the remainder of the propellant (i.e. 85-75 w %) can be N2O.

Besides, at least part of the propellant can be packed separately from the foodproduct, for example in the case that the container is provided with a movable or flexible partition to provide such separation (such as in European patent application EP 1 061 006 A1). However, in a more preferred embodiment, the propellant and foodproduct are packed together, in the same reservoir, in the aerosol container.

In a particular embodiment, the foodproduct comprises cream. In that case, as will be appreciated by the skilled person, the "spray cream" that is obtained from use of the present aerosol container 1 generally differs from conventional whipping cream (obtained from manually or automatically whipping common cream without using a cream propellant) to a high degree. Also, in the case the foodproduct comprises cream as an ingredient, the foodproduct can comprise various other ingredients, for example sugar, emulsifier, stabiliser, aroma. Preferably, the cream has a fat content in the range of about 5%-50%, for example about 40%. An other cream composition can include a fat milk constituent (particularly cream, or common cream) and a non-fat milk constituent (for example skimmed milk), see EP 1 061 006 A1. Generally, a cream foodproduct can comprise at least 80 w % of one or more milk constituents, and preferably at least circa 90 w %.

Referring to the drawings, the present container 1 is also provided with operable discharge means N (partly shown in FIG. 8) to discharge the foodproduct from the reservoir 2 into the dispensing head 10. Preferably, the discharge means are firmly, undetachably, attached to the container 1.

The present container 1 comprises a generally mushroom shaped dispensing head 10 defining a foodproduct receiving space 11 to receive the foodproduct from the discharge means, a distal part 15 of the head 10 (which part is located downstream, viewed in a general foodproduct flow direction, in longitudinal/axial container direction) having foodproduct shaping projections 12. The present container 1 is configured to be used upside down, with the dispensing head 10 substantially in a downward direction, and therefore does not comprise a dip-tube dispensing mechanism.

As an example, the foodproduct discharge means of the container can be provided with operable valve means (not depicted), comprising a downwardly (i.e. towards a container bottom) depressible foodproduct ejection nozzle N (see FIG. 8) and spring means to counteract the depressing of the nozzle, such as in a currently marketed spray foodproduct aerosol container, as will be appreciated by the skilled person. For example, depressing of the foodproduct ejection nozzle N leads to opening of the valve means so that foodproduct and part of the propellant can be ejected into the foodproduct receiving space 11 of the dispensing head 10, to be shaped and dispensed by the dispensing head 10. Mentioned spring means can close the valve means after the depressing of the nozzle N. Flow of foodproduct (and propellant) through the nozzle N is indicated by an arrow F in FIG. 8.

In the present embodiment, the foodproduct dispensing head 10 is provided with an integral ring shaped connecting member 3 which is coupled to a circumferential flange of a top part of the container. As follows from FIGS. 3, 6 and 8, an upstream part of the dispensing head 10 comprises a nozzle receiving aperture 21 to cooperate with the nozzle of the container 1. A bottom of the foodproduct receiving area 11 of the head 11 comprises a relatively broad first foodproduct passage extending opposite the foodproduct ejection nozzle after assembly, to receive foodproduct there-from. In the present embodiment, the first foodproduct passage is covered in an axial direction (i.e., axial with respect to a centre line L of the container 1) by a foodproduct dispersing member 23, wherein a plurality of second passages 24 (three in the present embodiment) extend through the dispersing member 23 in lateral directions. For example, widths W of the second passages 24 (see FIG. 7) can be smaller than 1 mm. However, the dispensing head 10 can also be configured in a different manner to receive foodproduct from the dispensing nozzle N, as will be appreciated by the skilled person.

In the present embodiment, the dispensing head 10 is movably connected to the connecting member 3, particularly tiltable about a tilting axis T (see FIG. 6), to depress the foodproduct ejection nozzle N of the container 1. Also, the head 10 comprises a knob part 22 for manual activation of dispensing of the foodproduct. Thus, activation of the discharge means of the container 1 can be achieved by manually operating (i.e. depressing, tilting) of the dispensing head 10. In an alternative embodiment, the foodproduct dispensing head is not movable with respect to the container 1, and a dedicated operating mechanism can be provided to activate the foodproduct dispensing means.

Preferably, during the manufacturing of the container 1, the foodproduct is first packed into the reservoir 2 via a filling aperture in the top of the container, after which the filling aperture is sealed, by assembly of the discharge means onto the container. Then, the propellant can be packed into the reservoir 2, preferably via the discharge means. In the latter case, the discharge means also serve as a filling means, to supply propellant to the reservoir 2 during the manufacture of the container.

Besides, as is shown in FIGS. 1-3, the container can be provided with a cap 20, preferably of a tamper evident configuration, to cover dispensing head, wherein the discharge means and dispensing head as such are preferably not provided with a tamper-evident configuration but are directly operable after removal of the cap from the container. A tamper-evident mechanism of the cap can be configured in various ways, and can comprise a breaking member 29 to break or rupture a tamper-evident connection between the cap 20 and a remaining part of the container, tearing means, deformation means, a one-way release or unlocking mechanism, or other suitable means. Thus, after removal of the cap, the discharge means and dispensing head can be operated in a logical and safe manner by a user, without the user needing to read a manual to understand the operation. Still, since the cap is tamper-evident, a first use of the container can be indicated and tampering of the container can be avoided.

Also, preferably, there is provided a method to manufacture the aerosol container 1, comprising:

- providing the aerosol container 1, comprising operable discharge means, and containing a propellant and foodproduct; and
- providing the cap 20 comprising the dispensing head 10 first (i.e., before being joined with the container). For example, the cap 20 and head 10 can be detachably or removably interconnected, particularly by mentioned tamper evident means or in a different manner.

In that case, it is advantageous if the cap 20 and the head 10 (i.e. the cap 20 comprising the head 10) are joined with the aerosol container 1, at the same time, such that the head 10 can cooperate with the discharge means of the container 1 after the joining of these components. Also, preferably, the cap is the a tamper-evident cap 20, having a mentioned tamper evident configuration to indicate a first removal of the cap from the container 1. In that case, the tamper evident configuration can be configured, for example, to become operable by the joining of the cap/head-assembly with the container 1 (so that a subsequent removal of the cap from the container can be indicated by the tamper evident means). Also, the joining of the cap and head with the container preferably does not lead to premature activation (for example rupture) of tamper evident means.

As follows from FIGS. 3-8, the dispensing head advantageously has an upstream foodproduct receiving part 16 having an inner surface with a diameter which widens when viewed along a foodproduct discharge direction (i.e., when viewed along the mentioned axial direction). The inner surface of the upstream head part 16 (which surface is faced towards the centre line of the head) defines a first, widening, frusco-conical foodproduct receiving space part 11A (i.e., widening when viewed in a dispensing direction, axially away from the bottom of the foodproduct receiving space). Also, the first part 17*a* of the inner surface of the upstream dispensing head part 16 extends along a virtual first conical plane (schematically indicated by dashed lines C1 in FIG. 6). In the present embodiment, the apex angle $\alpha$1 of the first conical virtual plane is in the range of 45-180 degrees, particularly in the range of 45-135 degrees and more particularly 80-120.

Moreover, a second part 17*b* of the inner surface of the upstream dispensing head part 16, defining at least a second (frusco-conical) part 11B of the upstream foodproduct receiving space, extends upstream with respect to the first part 17*a* of that surface, and extends along a virtual second conical plane. The apex angle $\alpha$2 of the second conical virtual plane C2 is smaller than the apex angle $\alpha$1 of the first conical plane C1, and is for example in the range of about 5-45 degrees, and particularly in the range of 10-30 degrees. In the present embodiment, the bottom of the foodproduct receiving space 11 abuts the second part 11B of that space 11, and the mentioned second foodproduct dispersing passages 24 lead into the radially most narrow part of the foodproduct receiving space.

Preferably, the inner surface 15*a* of the distal part 15 of the dispensing head 10 (consisting of the inner surfaces 15 of the foodproduct shaping projections 12, in the present embodiment) substantially extends along a virtual third conical surface C3. The apex angle $\alpha$3 of the third conical surface is preferably in the range of about 45-135 degrees and more preferably in the range of about 60-100 degrees, for example in the range of 70-80 degrees. For example, improved operation can be provided in the case that the apex angle $\alpha$1 of a mentioned first conical surface is at least 10 degrees larger than the apex angle $\alpha$3 of the third conical surface. As a non limiting example, apex angle $\alpha$1 can be about 120°, apex angle $\alpha$2 can be about 16° and apex angle $\alpha$3 can be about 72°.

Preferably, opposite longitudinal sides of the foodproduct shaping projections 12 abut foodproduct dispensing passages or apertures 19, the passages 19 extending from an upstream end of an upstream contour of the widening foodproduct receiving space part. As is shown, the upstream ends of these foodproduct dispensing passages 19 are located at the widest part of the dispensing head (i.e., the radially widest part of the foodproduct receiving space 11), at the edge between the distal head part 15 and the upstream widening head part 16. Downstream ends of the foodproduct dispensing passages 19 join a central downstream main foodproduct discharge opening 18 of the dispensing head 10. Also, for example, as in the drawings, the lateral diameter D2 of the main discharge opening 18 can be larger than the diameter D3 of the opposite bottom surface area of the foodproduct receiving space 11.

Besides, in a further embodiment, a length L1 of the foodproduct receiving space 11, measured from the upstream bottom of that space 1 to a downstream lateral foodproduct discharge opening 18 of the dispensing head, can be smaller than 3 cm, so that a compact and relatively hygienic dispensing head can be provided.

Also, in an embodiment, the axial length L2 of the first upstream part 11A of the foodproduct receiving space 11 can substantially the same as or smaller than the axial length L3 of the second upstream part 11B of that space 11. As a non limiting example, the axial length L2 of the first upstream part 11A of that space 11 can be in the range of 0.5-1 cm, for example about 6 mm, and the axial length L3 of the first upstream part 11B of that space 11 can be in the range of 0.5-1 cm, for example about 7 mm. Moreover, as in the present embodiment, the overall length (L2+L3) of the upstream widening foodproduct receiving space 11A, 11B can be larger than at least half the overall length L1 of the foodproduct receiving space 11 (thus: L2+L3>½×L1)

Besides, it has been found that, preferably, a maximum diameter D1 of the foodproduct receiving space of the dispensing head can be larger than 2 cm, or in the range of 2-3 cm.

Besides, preferably, a minimum diameter D3 of the foodproduct receiving space (i.e. the diameter D3 of the bottom) of the dispensing head can be smaller than 1 cm, for example about 6 mm. Besides, preferably, in the present embodiment, the diameter D4 of the inner head edge extending between the first and second upstream foodproduct receiving space part 11A, 11B can be smaller than 1 cm but larger than the mentioned minimum diameter D3 (for example, D4 can be about 9 mm).

For example, the ratio between the mentioned length of the foodproduct receiving space 11 and the mentioned maximum diameter D1 of that space (L1:D1) can be in the range of 1:2-2:1, more specifically 1.5:2-2:1.5, for example about 1:1.

Above mentioned dimensions are examples only, but have been found to provide good results.

In the present embodiment, when viewed in a longitudinal cross-section, inner surfaces of the foodproduct shaping portions and the inner surface of an upstream foodproduct receiving part of the dispensing head include angles β in the range of about 60-120 degrees, particularly 80-100 degrees. Thus, during operation, radially outer foodproduct parts of a discharging foodproduct can run along the inner surface of the upstream discharge head part 16 towards the foodproduct shaping projections 12 and intersect the foodproduct shaping projections 12 at substantially right angles β.

During use, of the embodiment shown in the figures, the container discharge means can be operated (after having removed the cap), by pressing down the discharge head 10. Thus, the valve means can be opened and foodproduct, preferably with some propellant, is discharged by the nozzle N into the upstream part 11A, 11B of the foodproduct receiving space. The upstream head part 16 guides the thus discharged (overrunning) foodproduct into the distal head part 15, towards the projections 12, intermediate apertures 19 and central outflow opening 18, such that the foodproduct is discharged from the head and obtains a desired shape. The present embodiment can produce a whipped foodproduct rosette (of 'spray foodproduct'), having a desired sharp relief and relatively deep foodproduct rosette grooves, in a relatively hygienic manner.

Although the illustrative embodiments of the present invention have been described in greater detail with reference to the accompanying drawings, it will be understood that the invention is not limited to those embodiments. Various changes or modifications may be effected by one skilled in the art without departing from the scope or the spirit of the invention as defined in the claims.

It is to be understood that in the present application, the term "comprising" does not exclude other elements or steps. Also, each of the terms "a" and "an" does not exclude a plurality. Any reference sign(s) in the claims shall not be construed as limiting the scope of the claims.

For example, the foodproduct shaping or profiling projections 12 as well as the intermediate apertures 19 can have various shapes and dimensions, depending on the amount of profiling is desired. For example, the latter intermediate apertures 19 can have substantially constant slit widths, can be tapered or have varying widths.

Also, boundary sections between various sections of the inner surface of the dispensing head include smooth curved sections. However, as follows from the above, relatively good results are obtained in case the boundary section between the shaping projections 12 and the upstream inner surface 17A of the foodproduct receiving space is abrupt, for example with an angle of about 80-100 degrees, for example about 90°.

Moreover, preferably, the inner head surface at the upstream foodproduct receiving space 11A, 11B can extend along at least one virtual conical plane C1, C2, however, also different surface shapes can be applied, for example ellipsoid or sphere-sections.

Besides, it has been found that the following features a), b), c) can also provide good dispensing results, particularly independent of the feature that a maximum diameter (D1) of the foodproduct receiving space of the dispensing head is larger than about 2 cm:

a) the feature that the inner surface (15*a*) of the distal part (15) of the dispensing head (10) substantially extends along a virtual third conical surface, an apex angle (α3) of the third conical surface being in the range of about 60-100 degrees;

b) the feature that the ratio between a length (L1) of the foodproduct receiving space (11) and a maximum diameter (D1) of that space L1:D1 is in the range of 1:2-2:1, more specifically 1.5:2-2:1.5, for example about 1:1; or c) the feature that, when viewed in a longitudinal cross-section, inner surfaces of the foodproduct shaping portions and the inner surface of an upstream foodproduct receiving part of the dispensing head include angles (β) in the range of about 60-120 degrees, particularly 80-100 degrees.

What is claimed is:

1. An aerosol container, comprising:

a reservoir containing a propellant and a foodproduct;

operable discharge means to discharge the foodproduct;

a dispensing head defining a foodproduct receiving space to receive the foodproduct from the discharge means, a distal part of the head having foodproduct shaping projections, characterised in that the foodproduct receiving space comprises an upstream foodproduct receiving space that widens, viewed in a foodproduct discharge direction, wherein:

at least a first part of an inner surface of an upstream dispensing head part, defining at least a first part of the upstream foodproduct receiving space, extends along a virtual first conical plane;

a second part of the inner surface of the upstream dispensing head part, defining at least a second pan of the upstream foodproduct receiving space, extends upstream with respect to the first part of that surface, and extends along a virtual second conical plane; and an apex angle of the second conical virtual plane is smaller than an apex angle of the first conical plane, and is in the range of about 5 degrees to about 45 degrees.

2. The container according to claim 1, wherein a maximum diameter of the foodproduct receiving space of the dispensing head is larger than about 2 cm.

3. The container according to claim 1, wherein the apex angle of the first conical virtual plane is in the range of from about 45 degrees to about 180 degrees.

4. The container according to claim 1, wherein the inner surface of the distal part of the dispensing head substantially extends along a virtual third conical surface.

5. The container according to claim 1, wherein, when viewed in a longitudinal cross-section, inner surfaces of the foodproduct shaping projections and the inner surface of an upstream foodproduct receiving part of the dispensing head include angles in the range of about 60 degrees to about 120 degrees.

6. The container according to claim 1 wherein a length of the foodproduct receiving space measured from an upstream bottom of that space to a downstream lateral foodproduct discharge opening of the dispensing head, is smaller than 3 cm.

7. The container according to claim 1, wherein opposite longitudinal sides of the foodproduct shaping projections abut foodproduct dispensing apertures, the apertures extending from an upstream end of an upstream contour of the widening foodproduct receiving space part.

8. The container according to claim 1, wherein the apex angle of the first conical virtual plane is in the range of from about 80 degrees to about 120 degrees.

9. The container according to claim 1, wherein the apex angle of the second conical virtual plane in the range of about 10 degrees to about 30 degrees.

10. The aerosol container of claim 1, wherein, when viewed in a longitudinal cross-section, inner surfaces of the foodproduct shaping projections portions and the inner surface of an upstream foodproduct receiving part of the dispensing head include angles in the range of about 80 degrees to about 100 degrees.

11. The aerosol container of claim 4, wherein an apex angle of the third conical surface is in the range of about 45 degrees to about 135 degrees.

* * * * *

UNITED STATES PATENT AND TRADEMARK OFFICE

CERTIFICATE OF CORRECTION

PATENT NO. : 8,419,411 B2
APPLICATION NO. : 12/440674
DATED : April 16, 2013
INVENTOR(S) : Werner Marie Camie Clauwaert et al.

It is certified that error appears in the above-identified patent and that said Letters Patent is hereby corrected as shown below:

In the Specification

Column 8, line 64: replace “pan” with “part”

Signed and Sealed this
Thirtieth Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,419,411 B2
APPLICATION NO. : 12/440674
DATED : April 16, 2013
INVENTOR(S) : Clauwaert et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 958 days.

Signed and Sealed this
First Day of September, 2015

Michelle K. Lee

Michelle K. Lee
*Director of the United States Patent and Trademark Office*